US008998364B2

(12) United States Patent
Sugita

(10) Patent No.: US 8,998,364 B2
(45) Date of Patent: Apr. 7, 2015

(54) PRINTING DEVICE AND METHOD OF CONTROLLING PRINTING DEVICE

(71) Applicant: Seiko Epson Corporation, Tokyo (JP)

(72) Inventor: Hiroshi Sugita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 13/768,170

(22) Filed: Feb. 15, 2013

(65) Prior Publication Data

US 2013/0215177 A1 Aug. 22, 2013

(30) Foreign Application Priority Data

Feb. 22, 2012 (JP) ..... 2012-036141

(51) Int. Cl.

| | |
|---|---|
| ***B41J 29/38*** | (2006.01) |
| ***B41J 2/07*** | (2006.01) |
| ***B41J 29/20*** | (2006.01) |
| ***B41J 2/045*** | (2006.01) |

(52) U.S. Cl.

CPC .. *B41J 2/07* (2013.01); *B41J 29/20* (2013.01); *B41J 2/04541* (2013.01); *B41J 2/04551* (2013.01); *B41J 2/04581* (2013.01); *B41J 2/04588* (2013.01); *B41J 2/04593* (2013.01); *B41J 2/04596* (2013.01)

(58) Field of Classification Search

CPC .... B41J 2/0458; B41J 2/04563; B41J 29/393; B41J 2/04591; B41J 2/04581

USPC ..... 347/9, 14, 19, 20, 32

See application file for complete search history.

(56) References Cited

U.S. PATENT DOCUMENTS

| | | | | |
|---|---|---|---|---|
| 7,510,255 | B2 | 3/2009 | Tamura et al. | |
| 2002/0093544 | A1 * | 7/2002 | Schloeman et al. | 347/10 |
| 2005/0264609 | A1 * | 12/2005 | Kubo et al. | 347/54 |
| 2006/0125853 | A1 * | 6/2006 | Misumi | 347/5 |
| 2009/0167815 | A1 * | 7/2009 | Ito | 347/32 |

FOREIGN PATENT DOCUMENTS

| | | |
|---|---|---|
| JP | 2003-075264 | 3/2003 |

* cited by examiner

*Primary Examiner* — Manish S Shah
*Assistant Examiner* — Yaovi Ameh

(57) ABSTRACT

A printing device includes a nozzle for discharging liquid, a counter that counts the number of signals for defining a cycle in which the liquid is discharged through the nozzle, and a discharge control portion that controls such that the liquid is not discharged through the nozzle when the number of signals counted by the counter is larger than a predetermined threshold value.

7 Claims, 8 Drawing Sheets

PRINTING DEVICE AND METHOD OF CONTROLLING PRINTING DEVICE

BACKGROUND

1. Technical Field

The present invention relates to a printing device and a method of controlling the printing device.

2. Related Art

As an example of a printing device, an ink jet printer which discharges ink has been known. The ink jet printer includes a plurality of nozzles and a head having driving elements (for example, piezoelectric elements) corresponding to the nozzles. The driving elements are driven by a driving signal to be supplied from a head driver IC mounted in the head so that ink is discharged through the corresponding nozzles. The head driver IC is driven to generate heat and the heat is dissipated by the ink to be discharged. However, if a temperature of the head driver IC is further increased with continuous driving or the like, there arises a failure on the head driver IC in some cases. Therefore, for example, in JP-A-2003-75264, increase in the temperature of the head driver IC is detected by a controller of an ink jet printer main body based on an anode voltage of a diode provided in the head driver IC.

However, in the case of the temperature detection in the ink jet printer as described in JP-A-2003-75264, a configuration of a temperature detector is required to be additionally provided in the head driver IC. Further, the controller of the ink jet printer main body is required to choose a timing at which a signal is detected from the temperature detector additionally provided in the head driver IC and there arises a risk that throughput of printing processing is deteriorated.

SUMMARY

An advantage of some aspects of the invention has been made in order to solve at least a part of the above-mentioned issues and can be realized in the following modes or Application Examples.

Application Example 1

A printing device according to an aspect of the invention includes a head that has a plurality of nozzles for discharging liquid and is capable of moving in a main scanning direction intersecting with a direction in which a medium is transported, driving elements that are provided so as to correspond to the plurality of nozzles and causes the liquid to be discharged through the nozzles, a counting portion that counts the number of signals for defining a discharge cycle in which the liquid is discharged through the nozzles on one pixel, and a discharge control portion that controls such that the liquid is not discharged through the nozzles when the number of signals counted by the counting portion is larger than a predetermined threshold value.

With the above-mentioned printing device, the counting portion counts the number of signals for defining the discharge cycle. Then, when the number of counted signals is larger than the predetermined threshold value, the discharge control portion controls such that the liquid is not discharged through the nozzles. In the printing device, a temperature of the head is also increased with continuous driving of the driving elements. Therefore, the number of signals for defining the discharge cycle is counted, and when the number of signals is larger than the threshold value, the discharge control portion controls such that the liquid is not discharged through the nozzles. With this, increase in the temperature of the head can be suppressed without lowering throughput of printing processing with a simple configuration in which a temperature detector is not additionally provided.

Application Example 2

In the printing device according to the aspect of the invention, it is preferable that the counting portion count the number of signals for each path on which the head moves in the main scanning direction, and the discharge control portion control such that the liquid is not discharged through the nozzles for each path.

With the above-mentioned printing device, the counting portion counts the number of signals for each path on which the head moves, and the discharge control portion controls such that the liquid is not discharged through the nozzles for each path. With this, for example, on the printing device having a relatively large size, increase in the temperature can be suppressed on each path effectively.

Application Example 3

In the printing device according to the aspect of the invention, it is preferable that the discharge control portion make the liquid micro-vibrate to the extent that the liquid is not discharged through the nozzles when the liquid is not discharged through the nozzles.

With the above-mentioned printing device, when the number of counted signals is larger than the threshold value, the increase in the temperature can be suppressed and the liquid can be prevented from being difficult to be discharged through the nozzles due to increase in viscosity of the liquid by making the liquid micro-vibrate.

Application Example 4

In the printing device according to the aspect of the invention, it is preferable that the discharge control portion set the threshold value based on a print resolution corresponding to a specified print mode.

With the above-mentioned printing device, the threshold value is set based on the print resolution corresponding to the print mode, thereby limiting a printable print range in the main scanning direction appropriately.

Application Example 5

A method of controlling a printing device according to another aspect of the invention, the printing device including a head that has a plurality of nozzles for discharging liquid and is capable of moving in a main scanning direction intersecting with a direction in which a medium is transported and driving elements that are provided so as to correspond to the plurality of nozzles and cause the liquid to be discharged through the nozzles, the method including counting the number of signals for defining a discharge cycle in which the liquid is discharged through the nozzles on one pixel, and controlling such that the liquid is not discharged through the nozzles when the number of signals counted in the counting is larger than a predetermined threshold value.

With the above-mentioned method of controlling the printing device, the number of signals for defining the discharge cycle is counted in the counting. Then, in the discharge controlling, the liquid is controlled so as not to be discharged through the nozzles when the number of signals counted in the counting is larger than the predetermined threshold value. In the printing device, the temperature of the head is also increased with continuous driving of the driving elements. Therefore, the number of signals for defining the discharge cycle is counted, and when the number of signals is larger than the predetermined threshold value, the liquid is controlled so as not to be discharged through the nozzles. With this, increase in the temperature of the head can be suppressed without lowering throughput of printing processing with a simple configuration in which a temperature detector is not additionally provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an ink jet printer (hereinafter, referred to as "printer") as a printing device according to a first embodiment is described with reference to the drawings.

Configuration of Printing Device

Figure 1:
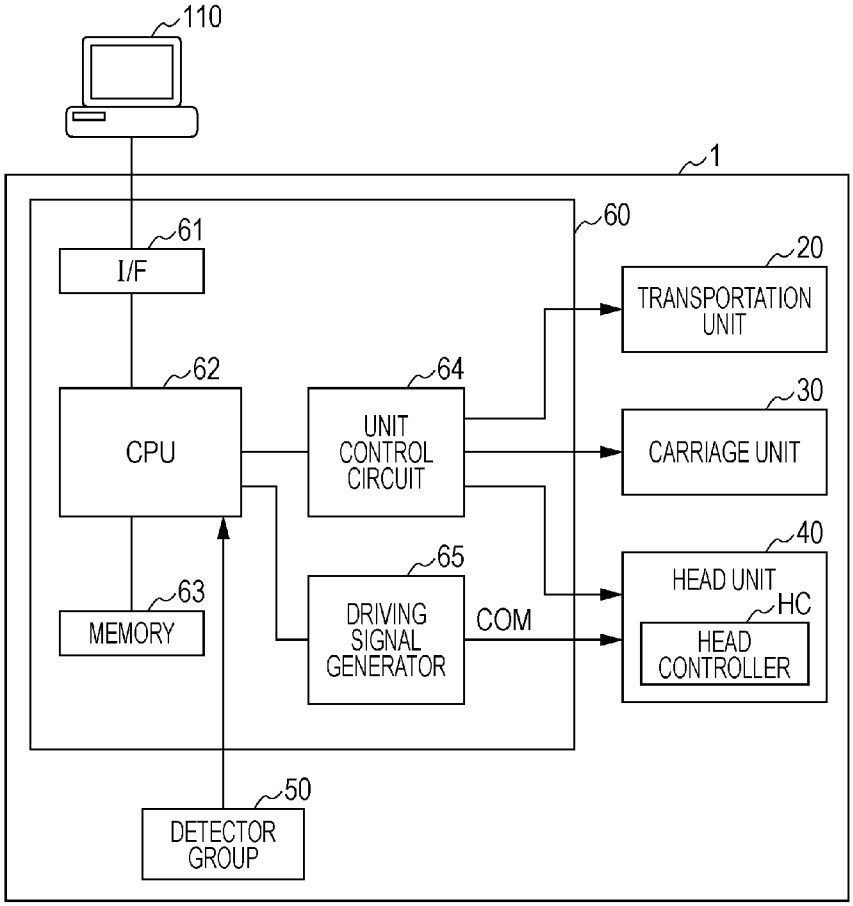
FIG. 1 is a block diagram illustrating an overall configuration of a printer according to the embodiment.
Figure 2A:
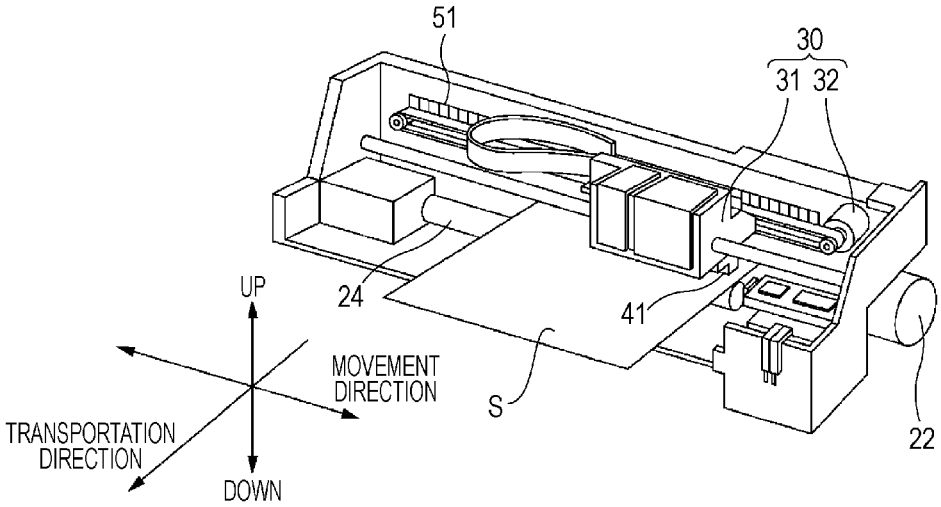
FIG. 2A is a perspective view illustrating the printer.
Figure 2B:
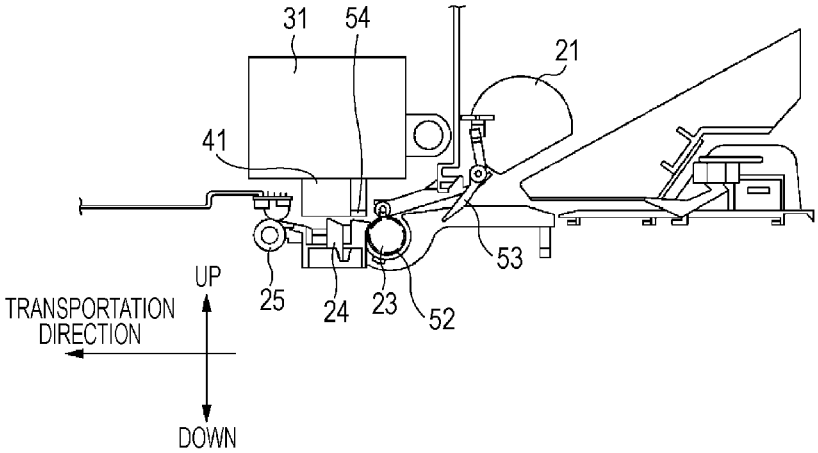
FIG. 2B is a transverse cross-sectional view illustrating the printer.

FIG. 1 is a block diagram illustrating an overall configuration of a printer 1 in the embodiment. Further, FIG. 2A is a perspective view illustrating the printer 1 and FIG. 2B is a transverse cross-sectional view illustrating the printer 1. Hereinafter, a basic configuration of the printer 1 in the embodiment is described.

The printer 1 in the embodiment includes a transportation unit 20, a carriage unit 30, a head unit 40, a detector group 50, a controller 60, and the like. If the printer 1 receives print data from a computer 110 as an external device, the printer 1 controls each unit (the transportation unit 20, the carriage unit 30, the head unit 40, and the like) by the controller 60. The controller 60 controls each unit so as to print an image on a medium (for example, sheet S or the like) based on the print data received from the computer 110. Further, a state in the printer 1 is monitored by the detector group 50. The detector group 50 outputs a detection result to the controller 60. The controller 60 controls each unit based on the detection result output from the detector group 50.

The transportation unit 20 is a unit for transporting the sheet S in the predetermined direction (hereinafter, referred to as "transportation direction"). The transportation unit 20 includes a sheet feeding roller 21, a transportation motor 22, a transportation roller 23, a platen 24, a sheet discharge roller 25, and the like. The sheet feeding roller 21 is a roller for feeding the sheet S inserted into a sheet insertion port into the printer 1. The transportation roller 23 is a roller for transporting the sheet S fed by the sheet feeding roller 21 to a printable region, and is driven by the transportation motor 22. The platen 24 supports the sheet S on which printing is being performed. The sheet discharge roller 25 is a roller for discharging the sheet S to the outside of the printer 1, and is provided at the downstream side with respect to the printable region in the transportation direction.

The carriage unit 30 is a unit for moving (also referred to as "scanning") the head 41 in the predetermined direction (hereinafter, referred to as "movement direction" or "main scanning direction"). The carriage unit 30 includes a carriage 31, a carriage motor 32, and the like. The carriage 31 can reciprocate in the movement direction, and is driven by the carriage motor 32. In addition, the carriage 31 holds an ink cartridge accommodating ink in a detachable manner.

The head unit 40 is a unit for discharging ink onto the sheet S. The head unit 40 includes a head 41 having a plurality of nozzles and a head controller HC. The head 41 is provided on the carriage 31. Therefore, if the carriage 31 moves in the movement direction, the head 41 also moves in the movement direction. Further, the head 41 discharges ink intermittently while moving in the movement direction so that a dot line (raster line) along the movement direction is formed on the sheet S. It is to be noted that details of the head unit 40 will be described later.

The detector group 50 includes a linear encoder 51, a rotary encoder 52, a sheet detection sensor 53, an optical sensor 54, and the like. The linear encoder 51 detects a position of the carriage 31 in the movement direction. The rotary encoder 52 detects a rotation amount of the transportation roller 23. The sheet detection sensor 53 detects a position of a front end of the sheet S which is being fed. The optical sensor 54 detects presence/absence of the sheet S with a light emitting portion and a light receiving portion which are attached to the carriage 31. Further, the optical sensor 54 detects positions of end portions of the sheet S while being moved by the carriage 31 so as to detect a width of the sheet S. In addition, the optical sensor 54 can also detect the front end (end portion at the downstream side in the transportation direction, and also referred to as "upper end") of the sheet S and a rear end (end portion at the upstream side in the transportation direction, and also referred to as "lower end") thereof depending on states.

The controller 60 is a control unit for controlling the printer 1. The controller 60 includes an interface (I/F) portion 61, a CPU 62, a memory 63, a unit control circuit 64, a driving signal generator 65, and the like. The interface portion 61 performs transmission and reception of data between the computer 110 as the external device and the printer 1. The CPU 62 is an arithmetic processing device for controlling the overall printer 1. The memory 63 is a memory for ensuring a region in which programs of the CPU 62 are stored, an operation region, and the like, and includes storage elements such as a RAM and an EEPROM. The CPU 62 controls each unit through the unit control circuit 64 in accordance with the programs stored in the memory 63. The driving signal generator 65 generates a common driving signal COM for driving piezoelectric elements PZT of the head 41, which will be described later.

Printing Procedures

Next, printing procedures on the printer 1 are described.

If the controller 60 receives a print direction and print data from the computer 110, the controller 60 analyzes contents of various types of commands contained in the print data so as to perform the following processing by using each unit.

At first, the controller 60 rotates the sheet feeding roller 21 so as to feed the sheet S on which printing is to be performed to the transportation roller 23. Next, the controller 60 drives the transportation motor 22 so as to rotate the transportation roller 23. If the transportation roller 23 is rotated by a predetermined rotation amount, the sheet S is transported by a predetermined transportation amount.

If the sheet S is transported to a lower portion of the head unit 40, the controller 60 rotates the carriage motor 32 based on the print direction. The carriage 31 is moved in the movement direction in accordance with the rotation of the carriage motor 32. Further, if the carriage 31 is moved, the head unit 40 provided on the carriage 31 is also moved in the movement direction at the same time. The controller 60 causes ink droplets to be discharged from the head 41 intermittently while the head unit 40 is being moved in the movement direction. The ink droplets land on the sheet S so that a dot row on which a plurality of dots (pixels) are aligned in the movement direction is formed. It is to be noted that a dot formation operation by discharging ink from the head 41 which is being moved is referred to as path. When the head unit 40 is moved on a forward path, the dot formation operation for one path is performed. Further, when the head unit 40 is moved on a backward path, the dot formation operation for one path is also performed.

Further, the controller 60 drives the transportation motor 22 while the head unit 40 reciprocates. The transportation motor 22 generates a driving force in the rotating direction in accordance with a driving amount directed from the controller 60. Then, the transportation motor 22 rotates the transportation roller 23 by using the driving force. If the transportation roller 23 is rotated by a predetermined rotation amount, the sheet S is transported by a predetermined transportation amount. That is to say, the transportation amount of the sheet S is defined in accordance with the rotation amount of the transportation roller 23. In this manner, the path and the transportation operation are repeated alternately so as to form dots on the pixels on the sheet S. Thus, an image is printed on the sheet S.

Finally, the controller 60 causes the sheet S on which printing has been finished to be discharged by the sheet discharge roller 25 which is rotated in synchronization with the transportation roller 23.

Configuration of Head

Next, a configuration of nozzles provided on the head 41 is described.

Figure 3:
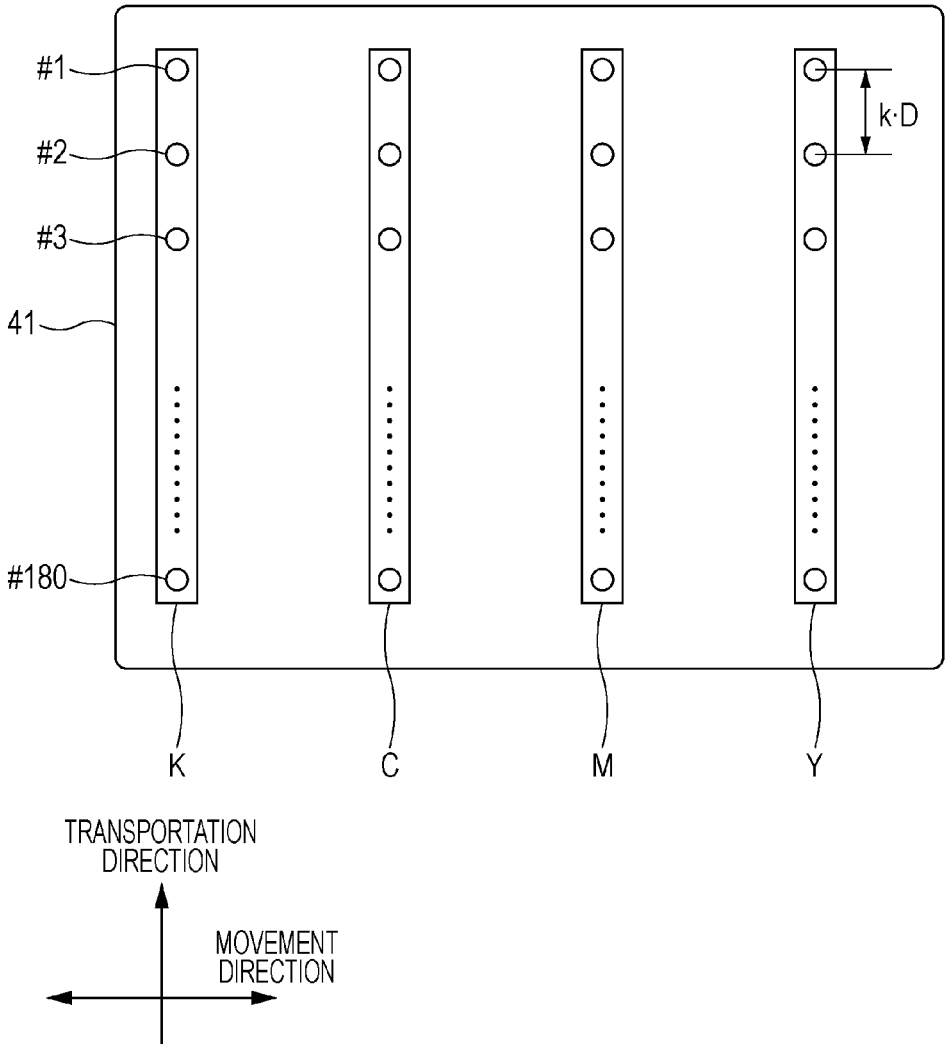
FIG. 3 is a view illustrating nozzle arrangement on the lower surface of a head.

FIG. 3 is a view illustrating nozzle arrangement on the lower surface of the head 41. A number of nozzles for discharging ink are provided on the lower surface of the head 41. The printer 1 in the embodiment can discharge inks of cyan, magenta, yellow, and black. Therefore, as illustrated in FIG. 3, a black nozzle row K for discharging black ink, a cyan nozzle row C for discharging cyan ink, a magenta nozzle row M for discharging magenta ink, and a yellow nozzle row Y for discharging yellow ink are formed on the lower surface of the head 41.

Each nozzle row is configured by a nozzle group having 180 nozzles (#1 to #180). The nozzles belonging to each nozzle row are denoted with numbers (#1 to #180) in the order from the nozzle at the downstream side in the transportation direction. Further, the nozzles on each nozzle row are aligned at a constant interval (nozzle pitch: k·D) in the transportation direction. Note that D indicates a minimum dot pitch (interval at the highest resolution of dots to be formed on the sheet S) in the transportation direction and k is an integer of equal to or higher than 1. For example, when the nozzle pitch is 180 dpi ($1/180$ inch) and the dot pitch in the transportation direction is 720 dpi ($1/720$ inch), k is 4.

Head Controller

Next, details of the head controller HC are described.

Figure 4:
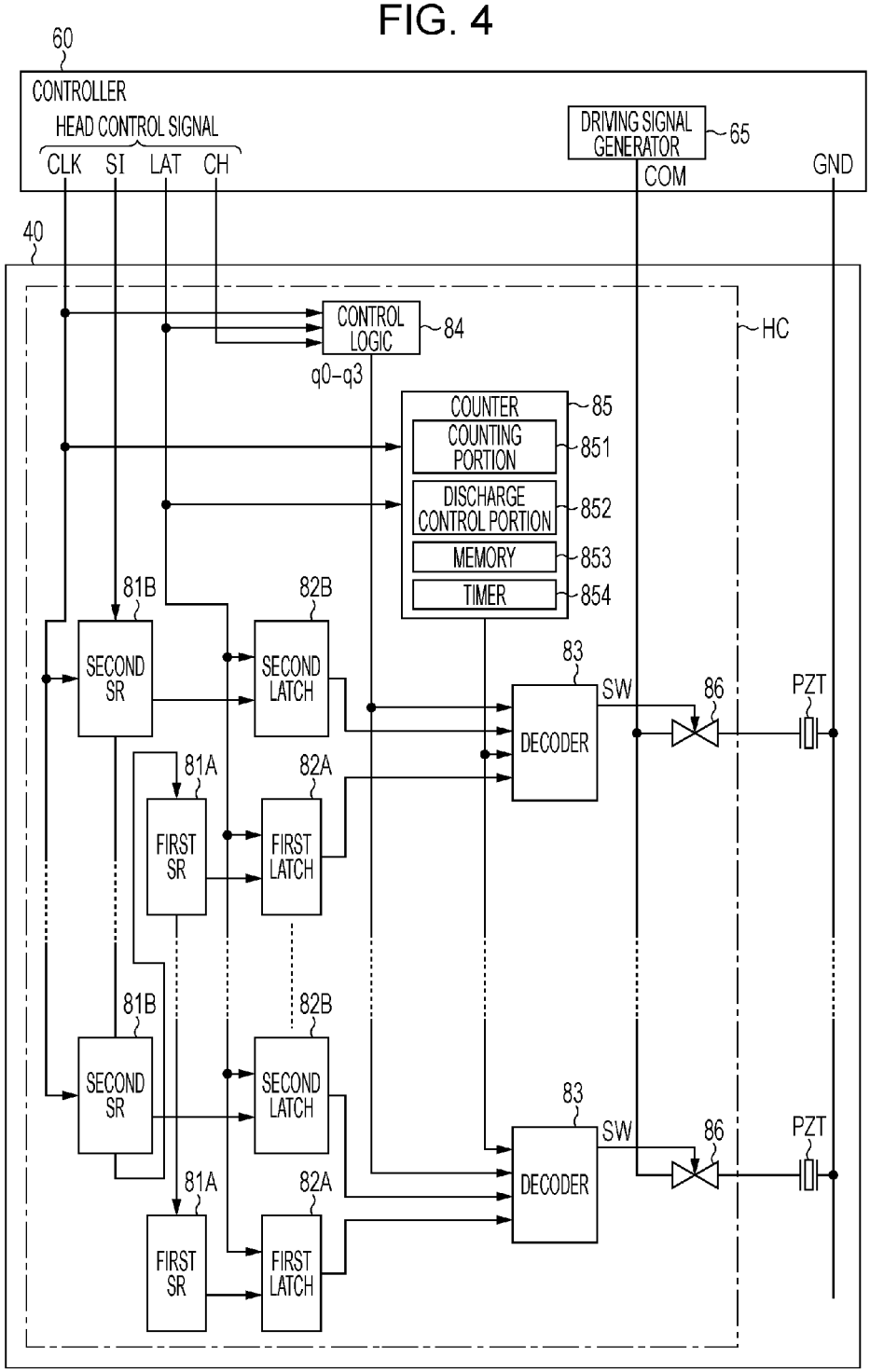
FIG. 4 is a descriptive view for explaining a head controller.
Figure 5:
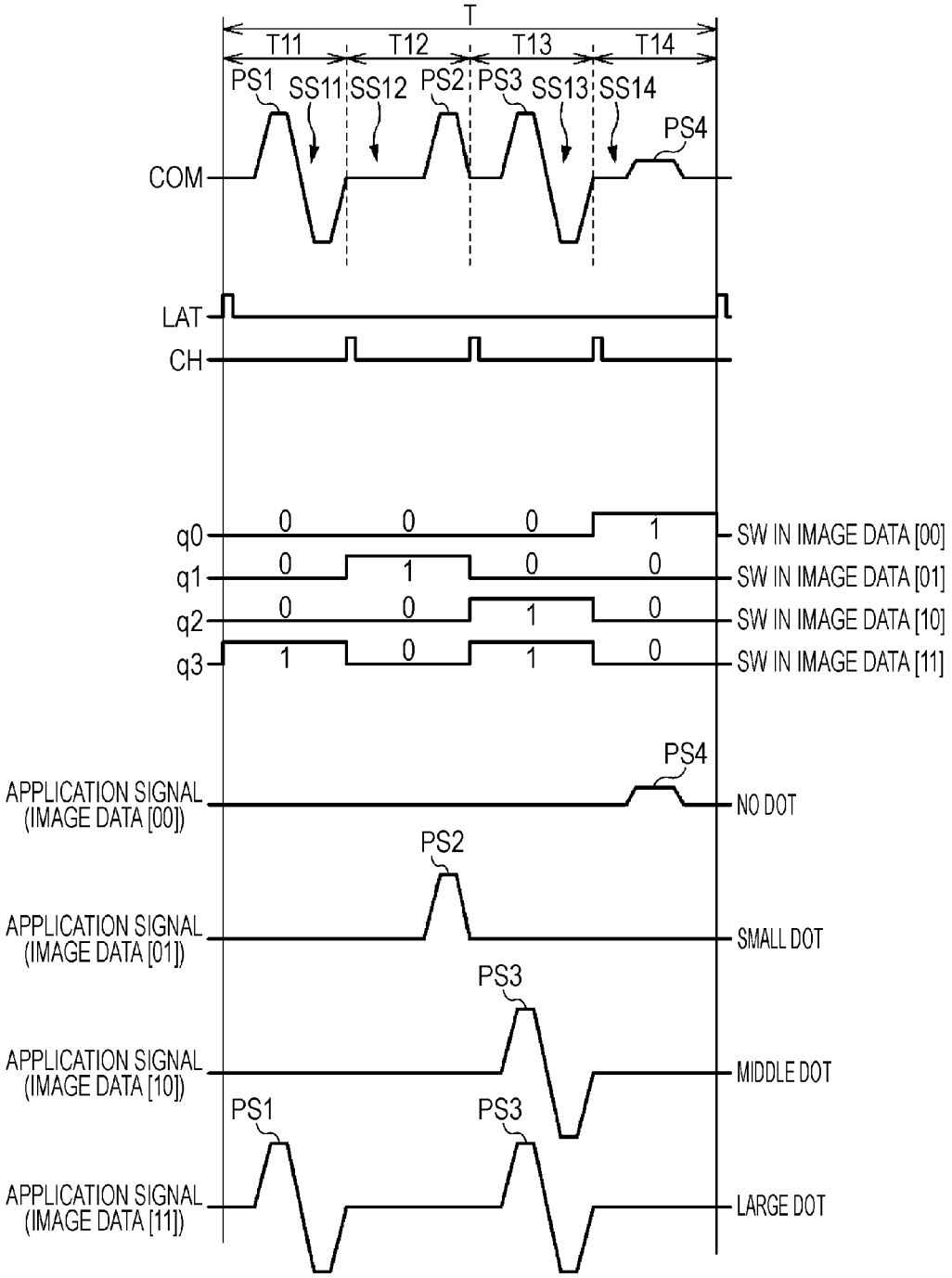
FIG. 5 is a descriptive view for explaining timings of various types of signals.

FIG. 4 is a descriptive view for explaining the head controller HC. FIG. 5 is a descriptive view for explaining timings of various types of signals. As illustrated in FIG. 4, the head controller HC includes first shift registers (SR) 81A, second shift registers (SR) 81B, first latch circuits 82A, second latch circuits 82B, decoders 83, a control logic 84, a counter circuit 85, and switches 86. The parts excluding the control logic 84 and the counter circuit 85 (that is, the first shift registers 81A, the second shift registers 81B, the first latch circuits 82A, the second latch circuits 82B, the decoders 83, and the switches 86) are provided for the respective piezoelectric elements PZT. It is to be noted that the piezoelectric elements PZT are elements (driving elements) which are driven for discharging ink droplets through the nozzles and are provided for the respective nozzles on the head 41.

The common driving signal COM and a head control signal including a latch signal LAT, a change signal CH, pixel data SI and a transfer clock CLK are transmitted to the head controller HC from the controller 60.

As illustrated in FIG. 5, the common driving signal COM is constituted by a first waveform portion SS11, a second waveform portion SS12, a third waveform portion SS13, and a fourth waveform portion SS14. The first waveform portion SS11 is generated in a period T11 in a repetitive cycle T. The second waveform portion SS12 is generated in a period T12. The third waveform portion SS13 is generated in a period T13. The fourth waveform portion SS14 is generated in a period T14. The first waveform portion SS11 has a driving pulse PS1. Further, the second waveform portion SS12 has a driving pulse PS2, the third waveform portion SS13 has a driving pulse PS3, and the fourth waveform portion SS14 has a driving pulse PS4. The driving pulse PS1 and the driving pulse PS3 are applied to the piezoelectric elements PZT when large dots are formed and have the same waveform. The driving pulse PS3 is also applied to the piezoelectric elements PZT when middle dots are formed. The driving pulse PS2 is applied to the piezoelectric elements PZT when small dots are formed. The driving pulse PS4 is applied to the piezoelectric elements PZT when dots are not formed. If the driving pulse PS4 is applied to the piezoelectric elements PZT, ink droplets are not discharged from the head 41 but ink in ink accommodation chambers (not illustrated) and pressure chambers (not illustrated) of the head 41 are made to micro-vibrate, thereby preventing clogging of ink in the nozzles.

The common driving signal COM is input to the respective switches 86 each of which is provided for each of the piezoelectric elements PZT. The switches 86 perform ON/OFF control whether or not the common driving signal COM is applied to the respective piezoelectric elements PZT so as to apply a part of the common driving signal COM to the piezoelectric elements PZT selectively. This makes it possible to change the sizes of dots. In this manner, each waveform portion corresponds to one unit to be applied to the piezoelectric elements PZT.

The latch signal LAT is a signal for defining a discharge cycle in which ink is discharged on one pixel through the nozzles and is a signal indicating the repetitive cycle T (period during which the head 41 moves in a section of one pixel). The latch signal LAT is generated by the controller 60 based on a signal of the linear encoder 51 and is input to the control logic 84, latch circuits (the first latch circuits 82A, the second latch circuits 82B), and the counter circuit 85.

The change signal CH is a signal indicating sections on which the driving pulses contained in the common driving signal COM are applied to the piezoelectric elements PZT. The change signal CH is generated by the controller 60 based on the signal of the linear encoder 51 and is input to the control logic 84.

The pixel data SI is a signal indicating whether a dot is formed on each pixel (that is, whether or not ink is discharged through each nozzle). The pixel data SI is constituted by 2 bits for one nozzle. For example, when the number of nozzles is 180, the pixel data SI of 2 bits×180 is transmitted from the controller 60 every repetitive cycle T. It is to be noted that the pixel data SI is input to the first shift registers 81A and the second shift registers 81B.

The transfer clock CLK is a signal to be used when the pixel data SI, the change signal CH, the latch signal LAT, and the like to be transmitted from the controller 60 are set to the control logic 84, the shift registers (the first shift registers 81A, the second shift registers 81B), the counter circuit 85, and the like.

Operation of Head Controller HC

Next, operation of the head controller HC is described.

The head controller HC controls to discharge ink based on the pixel data SI from the controller 60. That is to say, the head controller HC controls ON/OFF of the switches 86 based on the print data so as to apply necessary waveform portions of the common driving signal COM to the piezoelectric elements PZT selectively. In other words, the head controller HC controls driving of the piezoelectric elements PZT.

The control logic 84 generates selection signals q0 to q3 based on the input latch signal LAT and the input change signal CH. Then, each of the generated selection signals q0 to q3 is input to the decoders 83 each of which is provided for each of the piezoelectric elements PZT.

The counter circuit 85 includes a counting portion 851, a discharge control portion 852, a memory 853, and a timer 854. The counting portion 851 counts the number of latch signals LAT based on pulses of the input latch signals LAT. The discharge control portion 852 determines whether or not the number of latch signals LAT counted by the counting portion 851 is larger than a threshold value stored in the memory 853. Then, when the number of latch signals LAT is larger than the threshold value, the discharge control portion 852 outputs a signal of an H level to the decoders 83. On the other hand, when the number of latch signals LAT is not larger than the threshold value, the discharge control portion 852 outputs a signal of an L level to the decoders 83. Note that the threshold value is a numerical value calculated based on heat generation restriction of the head controller HC and has been stored in the memory 853 in advance. Further, when the number of latch signals LAT is larger than the threshold value, a certain period of time during which the latch signal LAT is not input is measured by the timer 854. Then, if a constant period of time has elapsed, counting by the counting portion 851 is cleared.

It is to be noted that the counter circuit 85 may not be included in the head controller HC and may be provided as an external circuit configuration. In addition, the number of latch signals LAT may not be counted and determined but may be determined based on an encoder signal to be output from the linear encoder 51. Further, for example, when a heat generator such as a platen heater or a UV irradiation lamp is provided, a threshold value with high accuracy may be set in accordance with environment based on the previous actual measured value.

Each decoder 83 selects any of the selection signals q0 to q3 based on the signal from the counter circuit 85 and the pixel data (2 bits) latched by the latch circuits (the first latch circuit 82A, the second latch circuit 82B). The selected selection signal is input to the corresponding switch 86 as a switch control signal SW.

Each switch 86 outputs an application signal based on the input common driving signal COM and the input switch control signal SW. The application signal is applied to each piezoelectric element PZT corresponding to each switch 86.

Then, a relationship between the pixel data SI and dots to be discharged through the nozzles is described. When a signal to be output from the counter circuit 85 is H level, that is, when the number of latch signals LAT is larger than the threshold value, the selection signals q0 are forcibly output from the decoders 83 as the switch control signals SW regardless of contents of the pixel data SI. With this, the switches 86 are made into ON states in the period T14 and the switches 86 are made into OFF states in the period T11 to the period T13. As a result, the driving pulse PS4 that the fourth waveform portion SS14 of the common driving signal COM has is applied to the piezoelectric elements PZT. In this case, ink droplets are not discharged through the nozzles but ink micro-vibrates by driving of the piezoelectric elements PZT and the ink in the nozzles is stirred. The ink droplets are not discharged and the ink is made to micro-vibrate so that a temperature of the head controller HC of which temperature has been increased can be lowered and the ink can be prevented from being difficult to be discharged through the nozzles due to increase in viscosity of the ink. In the above description, when the number of latch signals LAT is larger than the threshold value, the selection signals q0 are output and ink droplets are not discharged through the nozzles. However, the relationship is not limited thereto and the temperature of the head controller HC may be lowered by performing cooling discharge with flushing of discharging ink droplets inversely.

On the other hand, when the signal to be output from the counter circuit 85 is L level, that is, when the number of latch signals LAT is not larger than the threshold value, a selection signal is selected in accordance with contents of the pixel data SI as follows.

When the pixel data SI indicates dot non-formation (in the case of pixel data [00]), the pixel data [00] is latched. Further, as in the case in which the signal from the counter circuit 85 is the H level, the selection signals q0 are output as the switch control signals SW. In this case, ink droplets are not discharged through the nozzles but ink micro-vibrates by driving of the piezoelectric elements PZT and the ink in the nozzles is stirred.

When the pixel data SI indicates small-dot formation (in the case of pixel data [01]), the pixel data [01] is latched and the selection signals q1 are output as the switch control signals SW. With this, the switches 86 are made into ON states in the period T12 and the switches 86 are made into OFF states in the period T11, the period T13, and the period T14. As a result, the driving pulse PS2 that the second waveform portion SS12 of the common driving signal COM has is applied to the piezoelectric elements PZT and ink droplets (small ink droplets) by amounts corresponding to the small dots are discharged through the nozzles.

When the pixel data SI indicates middle-dot formation (in the case of pixel data [10]), the pixel data [10] is latched and the selection signals q2 are output as the switch control signals SW. With this, the switches 86 are made into ON states in the period T13 and the switches 86 are made into OFF states in the period T11, the period T12, and the period T14. As a result, the driving pulse PS3 that the third waveform portion SS13 of the common driving signal COM has is applied to the piezoelectric elements PZT and ink droplets (middle ink droplets) by amounts corresponding to the middle dots are discharged through the nozzles.

When the pixel data SI indicates large-dot formation (in the case of pixel data [11]), the pixel data [11] is latched and the selection signals q3 are output as the switch control signals SW. With this, the switches 86 are made into ON states in the period T11 and the period T13 and the switches 86 are made into OFF states in the period T12 and the period T14. As a result, the driving pulse PS1 that the first waveform portion SS11 of the common driving signal COM has and the driving pulse PS3 that the third waveform portion SS13 of the common driving signal COM has are applied to the piezoelectric elements PZT and ink droplets (large ink droplets) by amounts corresponding to the large dots are discharged through the nozzles.

In this manner, the head controller HC applies predetermined driving pulses of the common driving signal COM, which are contained in the repetitive cycle T, to the piezoelectric elements PZT based on the number of latch signals LAT and the image data SI loaded in accordance with the latch signals LAT.

Number of Latch Signals LAT and Print Width

Next, a relationship between the number of latch signals LAT and a print width of the sheet S is described.

Figure 6:
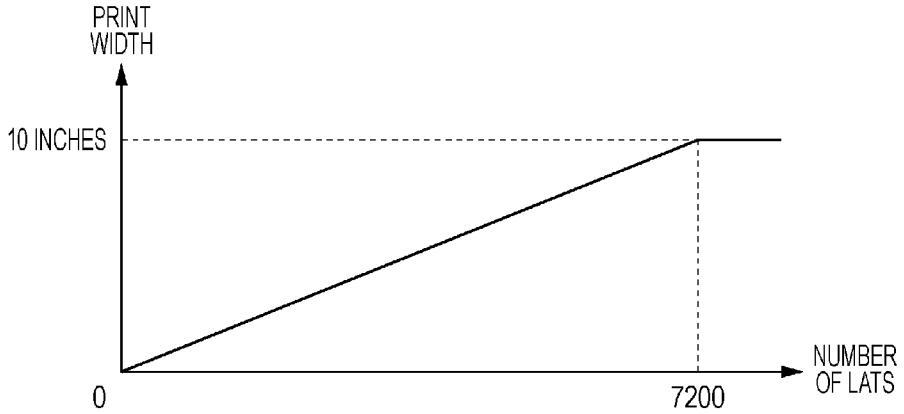
FIG. 6 is a graph illustrating a relationship example between the number of latch signals and a print width of a sheet.
Figure 7:
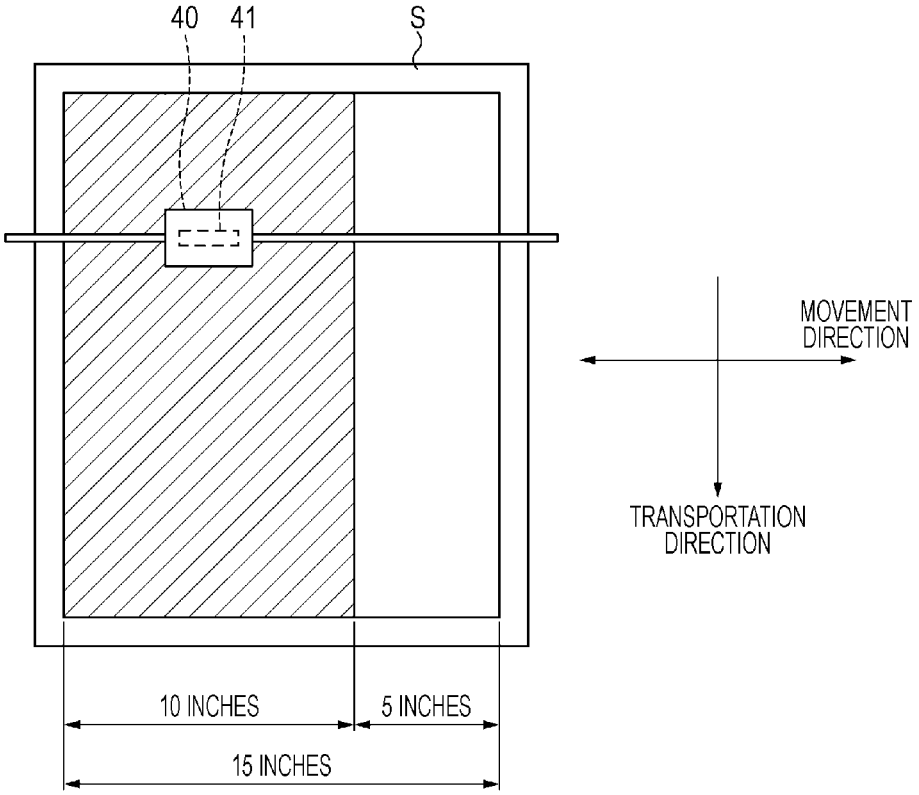
FIG. 7 is a view illustrating an example of a printable region on the sheet.

FIG. 6 is a graph illustrating a relationship example between the number of latch signals LAT and the print width of the sheet S. FIG. 7 is a view illustrating an example of a printable region on the sheet S. In FIG. 6 and FIG. 7, an example in which an image is printed at a print resolution of 720 dpi×720 dpi (resolution in the movement direction×resolution in the transportation direction) is illustrated. Further, a numerical value of "7200" is stored in the memory 853 of the counter circuit 85 as a threshold value.

As illustrated in FIG. 6, in proportion to increase in the number of latch signals LAT on one path, that is, increase in the number of pixels to be printed on one path, the print width of the sheet S is increased for an amount thereof. Further, after the number of latch signals LAT has reached "7200" as the threshold value, ink is not discharged. Therefore, the print width is limited to "10 inches" and even if the head unit 40 is further moved in the movement direction, printing is not performed thereafter. As a result, as illustrated in FIG. 7, for example, even if print data for printing an image having a print width of "15 inches" on the sheet S is used, only an image for an amount of the print width of "10 inches" is printed actually and an image for an amount of the remaining print width of "5 inches" corresponds to a space.

As described above, in the embodiment, the number of latch signals LAT is counted during printing for one path, and when the number of counted latch signals LAT is larger than a threshold value calculated based on heat generation restriction of the head controller HC, ink droplets are not discharged and ink is made to micro-vibrate. With this, a trouble that the temperature of the head controller HC is increased excessively to cause a failure being generated on the head controller HC can be prevented from occurring. In addition, the limit of the print width which can be printed actually by the printer 1 is defined to a print width which can be printed in a range of the heat generation restriction of the head controller HC. This makes it possible to prevent the head 41 from being operated beyond the capacity limit of the head 41.

Second Embodiment

Hereinafter, a printer according to a second embodiment is described with reference to the drawings.

The printer 1 according to the second embodiment has a configuration which is the same as that of the printer 1 according to the first embodiment. However, the printer according to the second embodiment is different from the printer 1 according to the first embodiment in a head control signal to be transmitted from the controller 60 to the head unit 40 and processing contents of the counter circuit 85 on the head controller HC.

Figure 8:
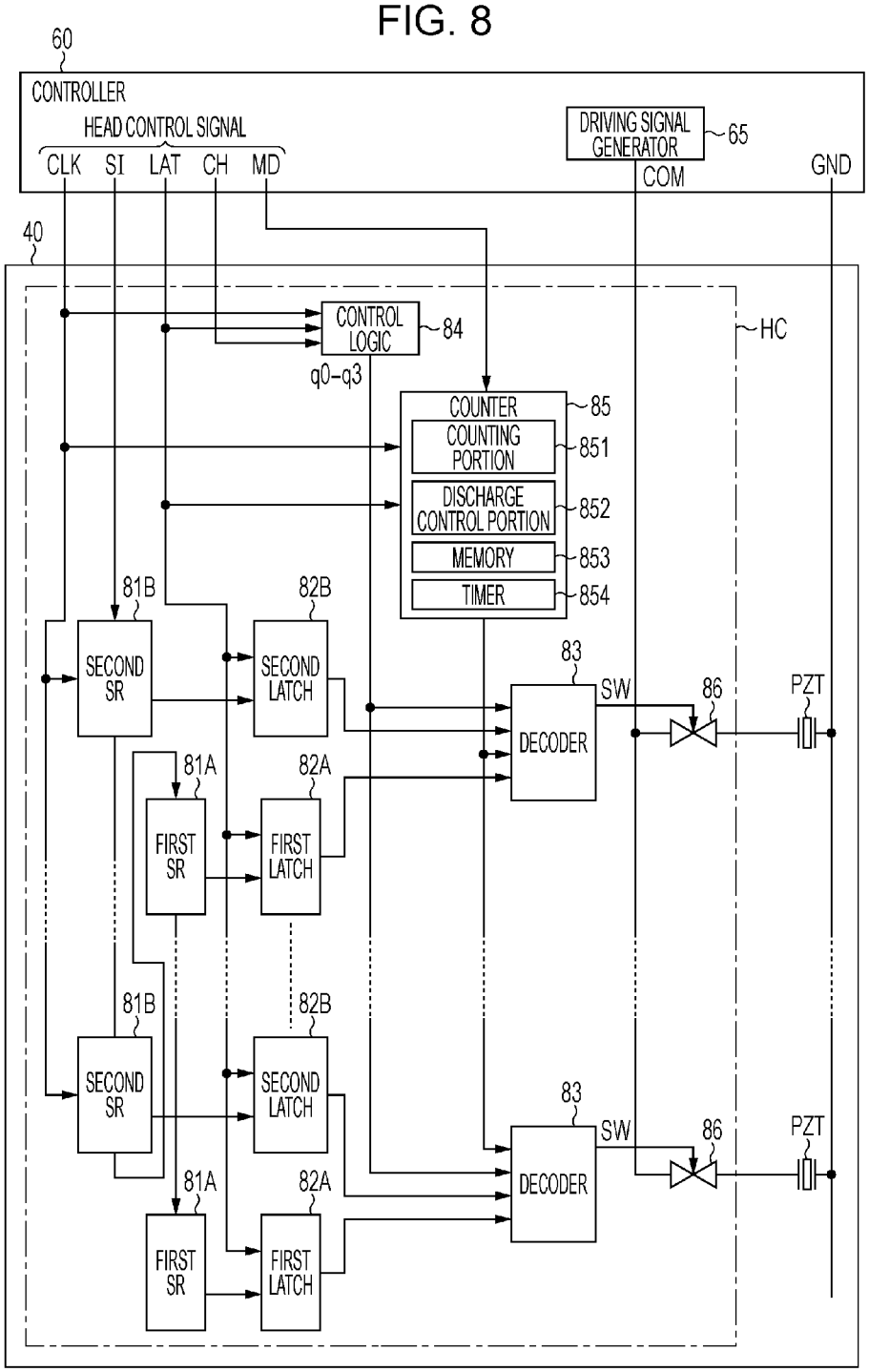
FIG. 8 is a descriptive view for explaining a head controller in a second embodiment.

FIG. 8 is a descriptive view for explaining the head controller HC in the second embodiment. In the second embodiment, a mode signal MD in addition to the common driving signal COM, the latch signal LAT, the change signal CH, the pixel data SI, and the transfer clock CLK are transmitted to the head controller HC from the controller 60. The mode signal MD is a signal to be determined in accordance with a print mode of the printer 1 which is specified by a user.

In the embodiment, a user can specify two types of print modes including a "fast mode" and a "clear mode". In the embodiment, the "fast mode" corresponds to a print mode in which an image is printed at a print resolution of 360 dpi×360 dpi. On the other hand, the "clear mode" corresponds to a print mode in which an image is printed at a print resolution of 720 dpi×720 dpi. In the printing in the "clear mode", a print speed is not faster than that in printing in the "fast mode" but an image with image quality which is higher than that in the "fast mode" can be printed. It is to be noted that the types of the print modes are not limited to two and more types of print modes may be made to be available. In such a case, a mode signal of a type corresponding to a resolution of each of the types of print modes is transmitted from the controller 60.

The mode signal MD transmitted from the controller 60 is input to the counter circuit 85. On the counter circuit 85, a threshold value in accordance with the input mode signal MD is set to the memory 853. In the embodiment, a numerical value of "3600" is set as a threshold value in the "fast mode" and a numerical value of "7200" twice as the threshold value in the "fast mode" is set as a threshold value in the "clear mode". Then, the discharge control portion 852 determines whether the number of latch signals LAT counted by the counting portion 851 is larger than the threshold value set in accordance with the mode signal MD. When the number of latch signals LAT is larger than the threshold value, the discharge control portion 852 outputs a signal of an H level to the decoders 83. On the other hand, when the number of latch signals LAT is not larger than the threshold value, the discharge control portion 852 outputs a signal of an L level to the decoders 83. It is to be noted that instead of the configuration in which the threshold value is set based on the mode signal MD from the controller 60, a configuration in which a resolution is determined automatically based on the transfer clock CLK, for example, on the head controller HC so as to set the threshold value may be employed.

Figure 9:
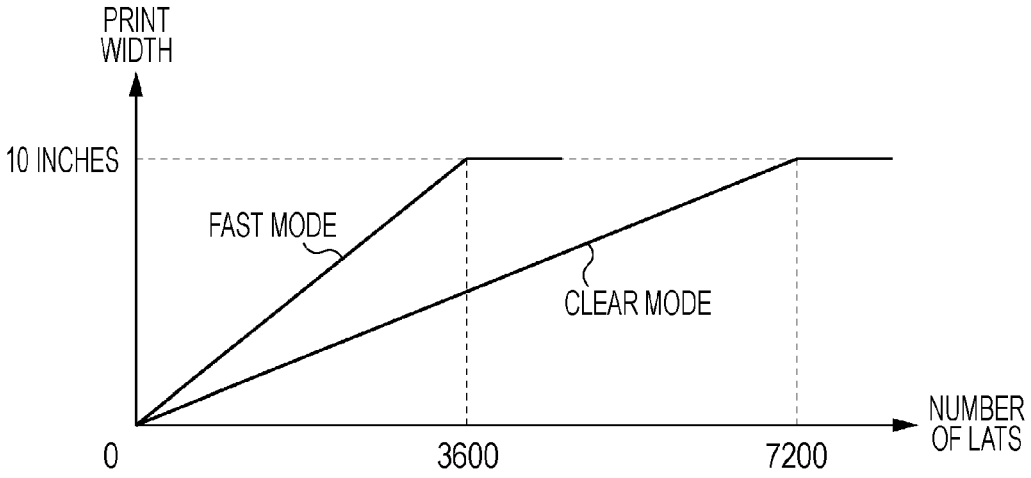
FIG. 9 is a graph illustrating a relationship example between the number of latch signals and a print width of a sheet in the second embodiment.

FIG. 9 is a graph illustrating a relationship example between the number of latch signals LAT and the print width of the sheet S in the second embodiment. In FIG. 9, the relationship example between the number of latch signals LAT and the print width of the sheet S is illustrated for each of the "fast mode" of 360 dpi×360 dpi and the "clear mode" of 720 dpi×720 dpi. As illustrated in FIG. 9, in the case of the "fast mode", after the number of latch signals LAT has reached "3600" as the threshold value, the print width is limited to "10 inches" and printing is not performed thereafter. On the other hand, in the case of the "clear mode", after the number of latch signals LAT has reached "7200" as the threshold value, the print width is limited to "10 inches" and printing is not performed thereafter as in the case of the "fast mode".

As described above, in the embodiment, the threshold value is made variable and the threshold value in accordance with the resolution in the print mode of the printer 1 is set. Further, in printing in each print mode, when the number of latch signals LAT is larger than the threshold value set in accordance with the print mode, ink droplets are not discharged and ink is made to micro-vibrate. Note that when the threshold value is not made variable in accordance with the print mode unlike the embodiment and the threshold value in each print mode is fixed as a common numerical value, there arises the following problem. For example, in FIG. 9, when the threshold value in the "fast mode" is set to "7200" which is the same as that in the "clear mode", the print width which can be printed in the "fast mode" is "20 inches" twice as "10 inches" (when restriction in a mechanism of the printer 1 is excluded). As a result, a print width which can be printed actually is made different depending on the types of the print modes.

Therefore, in the embodiment, a threshold value with which a temperature of the head controller HC can be suppressed to be within the heat generation restriction and the limit of the print width which can be printed can be made uniform in printing in the respective print modes is set. With this, when the temperature of the head controller HC is suppressed to be within the heat generation restriction, a problem that the print width which can be printed actually is made different depending on the types of the print modes can be solved.

Modification 1

In the above-mentioned embodiment, the ink jet printer has been described as an example of the printing device. However, the printing device is not limited to the ink jet printer and can be also applied to printing device which discharge liquids (in addition to the liquids, including a liquid-state material in which particles of a functional material are dispersed, and a liquid-state material such as gel) other than ink and fluids other than the liquids (solids which can be discharged as fluids, for example, powder). For example, the above-mentioned embodiment may be applied to printing devices which discharge liquid-stare coloring materials and electrode materials to be used for manufacturing liquid crystal displays, electroluminescence (EL) displays, surface emitting displays, and the like. Further, the above-mentioned embodiment may be applied to printing devices which discharge liquid-state bioorganic materials to be used for manufacturing biochips.

Modification 2

In the above-mentioned embodiment, the printer is employed so that ink is discharged through the nozzles. However, the ink may be aqueous ink or oil-based ink. Further, fluid which is discharged through the nozzles is not limited to the ink. For example, liquids (including water) containing metal materials, organic materials (in particular, macromolecular materials), magnetic materials, conductive materials, wiring materials, film formation materials, electronic inks, processed liquids, or genetic solutions, for example, may be discharged through the nozzles.

The entire disclosure of Japanese Patent Application No. 2012-036141, filed Feb. 22, 2012 is expressly incorporated by reference herein.

What is claimed is:

1. A printing device comprising:

a nozzle for discharging liquid a plurality of times onto a print medium during a liquid discharge cycle, wherein said print medium is transported in a transportation direction, and the liquid discharge cycle is defined by a scanning path movement of the nozzle in a main scanning direction different from the transportation direction;

a counter that counts the number of pulses of a control signal that indicates an initiation of a discharge of liquid through the nozzle in a current liquid discharge cycle; and a discharge control portion that halts all discharges of liquid for the remainder of the current liquid discharge cycle when the number of pulses of the control signal counted by the counter in the current liquid discharge cycle reaches a count value larger than a predetermined threshold value.

2. The printing device according to claim 1, wherein the counter counts anew the number of pulses of the control signal issued during each new scanning path movement of the nozzle in the main scanning direction; and the discharge control portion controls the halting of liquid discharges through the nozzle in each new scanning path movement.

3. The printing device according to claim 1, wherein the discharge control portion makes the liquid micro-vibrate when it halts the discharge of liquid in the current liquid discharge cycle.

4. The printing device according to claim 1, wherein the discharge control portion sets the threshold value based on a print resolution corresponding to a specified print mode.

5. The printing device according to claim 1, wherein the predetermined threshold value is increased as a print resolution of the printing device is increased.

6. The printing device according to claim 1, wherein:

the liquid discharge cycle is defined by a full scanning path movement of the nozzle in the main scanning direction;

a printing resolution of the printing device is selectable among a plurality of printing resolution options; and a different one of said predetermined threshold is defined for each available printing resolution option value so that an amount of printable space within each scanning path movement remains constant when switching from one printing resolution option to another.

7. A method of controlling a printing device, comprising:

discharging liquid a plurality of times onto a print medium during a liquid discharge cycle using a plurality of nozzles for discharging liquid, wherein said print medium is transported in a transportation direction, and the liquid discharge cycle is defined by a scanning path movement of the nozzles in a main scanning direction different from the transportation direction;

counting the number of pulses of control signals that indicate an initiation of a discharge of liquid through the nozzles in a current liquid discharge cycle;

halting all discharges of liquid through the nozzles for the remainder of the current liquid discharge cycle when the number of pulses of the control signals counted in the current liquid discharge cycle reaches a count value larger than a predetermined threshold value.

* * * * *